US005695074A

United States Patent [19]

Wiese

[11] Patent Number: 5,695,074

[45] Date of Patent: Dec. 9, 1997

[54] GRAVITY FEED BOTTLE DISPLAY AND DISPENSING RACK

[75] Inventor: Lee R. Wiese, Upper Nyack, N.Y.

[73] Assignee: Henschel-Steinau, Inc., Englewood, N.J.

[21] Appl. No.: 540,497

[22] Filed: Oct. 10, 1995

[51] Int. Cl.[6] ..... A47F 1/00

[52] U.S. Cl. ..... 211/59.2; 211/74; 211/75; 221/289

[58] Field of Search ..... 211/75, 59.2, 74; 248/312.1; 221/289, 251

[56] References Cited

U.S. PATENT DOCUMENTS

| | | | |
|---|---|---|---|
| 1,958,781 | 5/1934 | Beukema | 211/74 |
| 1,973,854 | 9/1934 | Hoffman et al. | 211/74 |
| 2,218,444 | 10/1940 | Vineyard . | |
| 2,289,751 | 7/1942 | Brenholt . | |
| 2,588,618 | 3/1952 | Di Renzo . | |
| 2,620,691 | 12/1952 | Gould | 211/74 |
| 2,772,787 | 12/1956 | Lee . | |
| 2,919,814 | 1/1960 | Berkowitz | 211/74 |
| 2,954,128 | 9/1960 | Gordon . | |
| 3,063,534 | 11/1962 | Amour . | |
| 3,243,220 | 3/1966 | Karas . | |
| 3,643,808 | 2/1972 | Ryan et al. | 211/49 |
| 4,310,097 | 1/1982 | Merl | 211/49 |
| 4,318,485 | 3/1982 | Clement | 211/49 |
| 4,367,818 | 1/1983 | Suttles | 211/49 |
| 4,401,221 | 8/1983 | Suttles | 211/49 |
| 4,423,816 | 1/1984 | Suttles | 211/59.2 |

FOREIGN PATENT DOCUMENTS

| | | | |
|---|---|---|---|
| 259169 | 2/1965 | Australia | 211/74 |
| 518117 | 2/1940 | United Kingdom | 211/74 |

*Primary Examiner*—Leslie A. Braun
*Assistant Examiner*—Donald J. Wallace
*Attorney, Agent, or Firm*—Arthur Jacob

[57] ABSTRACT

A rack for storing and presenting, for serial dispensing, a plurality of bottles suspended from a suspension location at an elevation in the rack in a line essentially parallel to the rack and through a dispensing station, the rack being inclined upwardly away from the dispensing station for biasing the bottles into the dispensing station by the force of gravity, a gate at the dispensing station having gate members including engagement surfaces for engaging the forwardmost bottle, placed in the dispensing station, at stabilizing locations below the elevation of the suspension location and spaced downwardly a vertical distance from the elevation of the suspension location, and above the elevation of the suspension location and spaced upwardly a vertical distance from the elevation of the suspension location sufficient to maintain the forwardmost bottle in an essentially vertical orientation, stabilized against the force of gravity, including the forward force of the remaining bottles suspended along the line behind the forwardmost bottle.

29 Claims, 5 Drawing Sheets

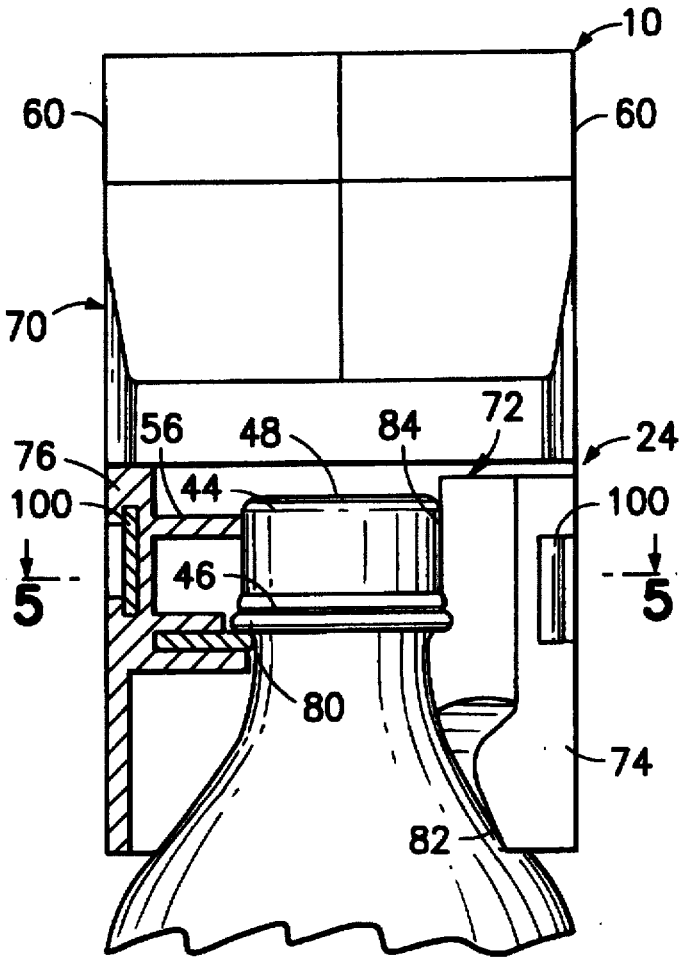
FIG. 4
FIG. 5
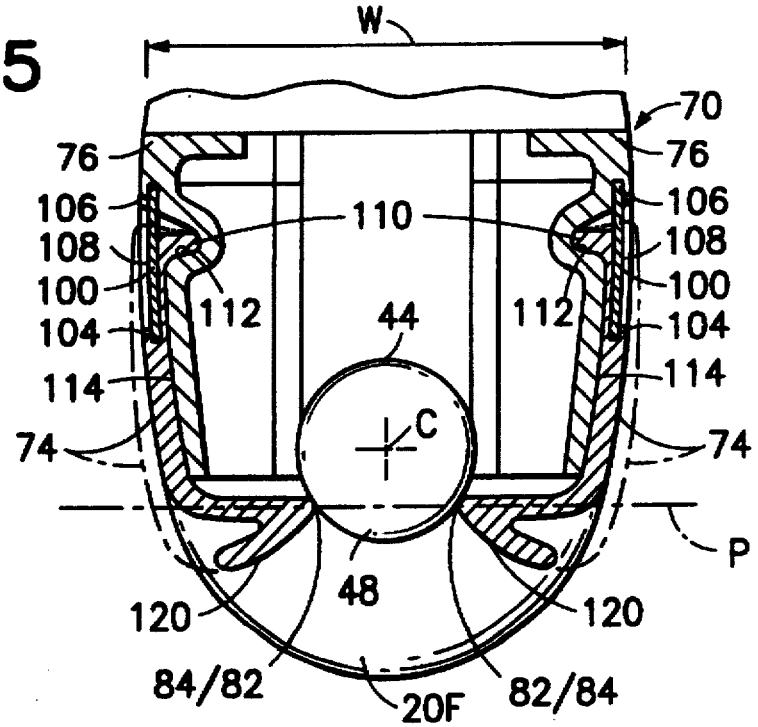

GRAVITY FEED BOTTLE DISPLAY AND DISPENSING RACK

The present invention relates generally to the display and dispensing of merchandise at a point of purchase and pertains, more specifically, to the display and dispensing of articles of merchandise in the form of bottles, such as soft drink bottles, offered to prospective purchasers at self-service dispensing locations.

Soft drinks commonly are presented at a point of purchase in refrigerated cabinets in which a plurality of soft drink bottles are made available for selection by a purchaser. Gravity feed racks have been employed in connection with such cabinets to maintain a supply of soft drink bottles available for dispensing serially at convenient dispensing locations, with the dispensed bottles being replaced by gravity feed from the supply so that a bottle consistently is made available for display and dispensing at the dispensing location.

Among the more common racks available for the display and serial dispensing, by gravity, of bottled soft drinks are those which employ trays for supporting a row of bottles with the bottoms of the bottles resting within a chute inclined toward the dispensing location. While such chutes generally are attractive and are effective in presenting bottles for ready selection, frequent maintenance is required to keep the chutes clean and free of accumulations of various matter which can impede operation of the rack, as well as have an adverse effect upon appearance and sanitation. In addition, certain current bottle configurations present a footprint which is not amenable to gravity feed in a bottom-supporting chute.

It has been suggested that soft drink bottles can be stored and dispensed along overhead tracks, with the bottles suspended along the tracks by the necks of the bottles, thereby eliminating the trays and chutes beneath the bottles and the accompanying problems of maintaining the desired cleanliness and appearance, and assuring unimpeded functioning of the rack. While such an arrangement offers advantages in cleanliness, appearance and unimpeded operation, difficulties have been encountered in assuring that a bottle presented at the dispensing location is held at a stable rest position, oriented for best presentation for selection by a purchaser, with consistent replacement each time the selected bottle is dispensed from the rack.

The present invention provides a rack in which bottles are suspended by the neck, along a line for delivery, by gravity, to a dispensing station where each bottle is presented in stable, appropriate orientation for selection by a purchaser. As such, the present invention attains several objects and advantages, some of which are summarized as follows: Provides a rack for delivering bottles serially, by gravity, to a dispensing station where a bottle is retained positively in a stable, desired orientation for presentation to a prospective purchaser; enables the desired cleanliness, appearance and consistent operation while attaining increased stability among the bottles stored along the rack, as well as in the bottles presented at the dispensing station; is adapted readily, in the field, to accommodating bottles of various sizes and configuration, selectively, without excessive modification; provides a relatively simple construction, made available economically for use in connection with a wide variety of dispensing units; enables increased ease of installation, maintenance and use; provides a rugged construction capable of reliable operation over a relatively long service life.

The above objects and advantages, as well as further objects and advantages, are attained by the present invention, which may be described briefly as a rack for storing and presenting, for serial dispensing, a plurality of bottles suspended from the rack in a line extending longitudinally essentially parallel to the rack and through a dispensing station, the bottles including a generally vertical body portion having a given surface contour configuration, a neck extending upwardly from the body portion, and a cap portion above the neck, the cap portion having a predetermined surface contour configuration, the rack comprising: a track extending along an incline upwardly away from the dispensing station for supporting the plurality of bottles along the line, with the bottles biased by gravity forwardly along a path of travel toward the dispensing station, the track engaging the neck of each bottle at a suspension location placed at an elevation in the dispensing station; and a gate at the dispensing station, the gate including stop means placed in the path of travel for engaging the forwardmost bottle of the plurality of bottles to retain the plurality of bottles in the rack; the stop means including at least one first engagement surface extending downwardly from the elevation of the suspension location along a first essentially vertical direction for engaging the generally vertical body portion of the forwardmost bottle at a corresponding at least one lower stabilizing location spaced away from the suspension location, vertically below the elevation of the suspension location, and at least one second engagement surface extending upwardly from the elevation of the suspension location along a second essentially vertical direction for engaging the cap portion of the forwardmost bottle at a corresponding at least one upper stabilizing location spaced away from the suspension location, vertically above the elevation of the suspension location, and resilient biasing means for resiliently biasing the first engagement surface into engagement with the generally vertical body portion of the forwardmost bottle at said corresponding lower stabilizing location and for resiliently biasing the second engagement surface into engagement with the cap portion of the forwardmost bottle at said corresponding upper stabilizing location such that the forwardmost bottle is maintained suspended at the dispensing station in an essentially vertical orientation against the force of gravity, including the forward force of the remaining bottles suspended along the line behind the forwardmost bottle and is selectively released from the dispensing station by pulling the forwardmost bottle forward through the gate, against the resilient bias of the resilient biasing means.

The invention will be understood more fully, while still further objects and advantages will become apparent, in the following detailed description of a preferred embodiment of the invention illustrated in the accompanying drawing, in which:

FIG. 4 is an enlarged fragmentary, partially sectioned front elevational view of a portion of the rack;

FIG. 5 is a cross-sectional view taken along line 5—5 of FIG. 4;

Figure 1:
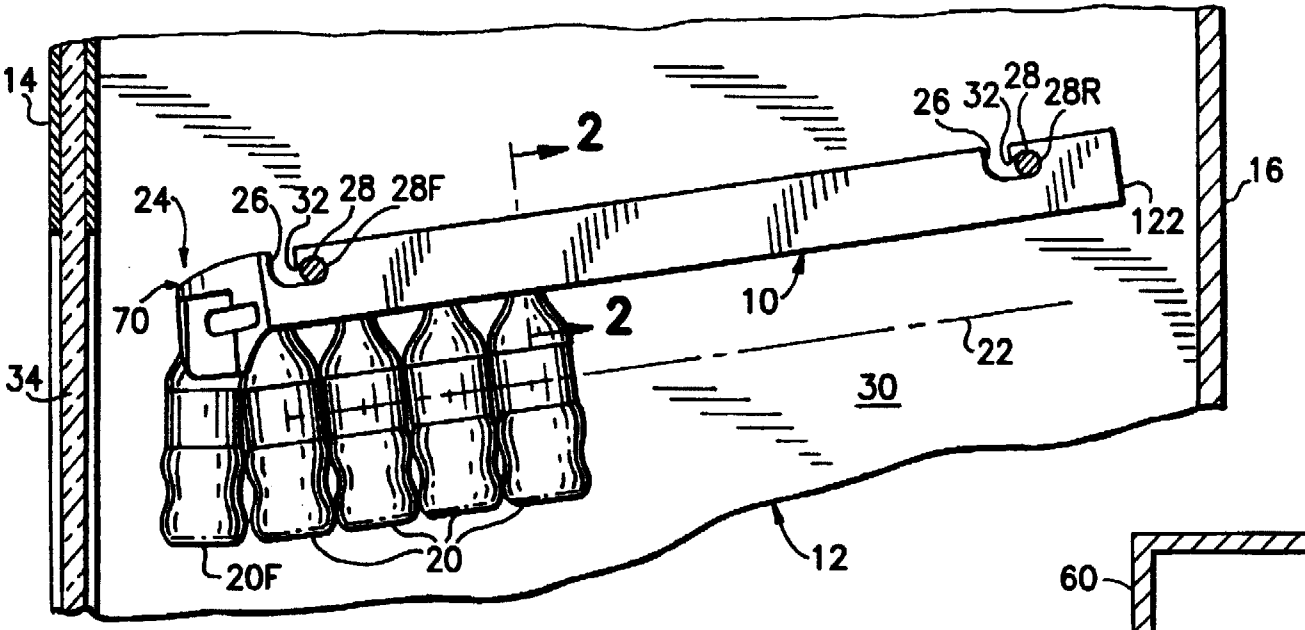
FIG. 1 is a side elevational view of a rack constructed in accordance with the invention, installed for use.

Referring now to the drawing, and especially to FIG. 1 thereof, a rack constructed in accordance with the present invention is shown at 10 and is seen to be installed in a refrigerated cabinet 12 having a front door 14 for gaining access to the rack 10, and a rear wall 16. Rack 10 carries a plurality of bottles 20 of soft drinks, the plurality of bottles 20 being suspended from the rack 10 in a line 22 extending longitudinally essentially parallel to the rack 10, with the forwardmost bottle 20F placed at a dispensing station 24 for presentation to a prospective purchaser (not shown). Rack 10 is mounted within cabinet 12 by means of slots 26 in the rack 10 which receive corresponding crossbars 28 secured between opposite side walls of the cabinet 12, one of which side walls is seen at 30, the crossbars 28 being secured to existing vertical supports (not shown) already available in such cabinets. The slots 26 are L-shaped, so as to be fitted over crossbars 28, and include detents 32 for locking the rack 10 onto the crossbars 28 at any lateral location along the crossbars 28, enabling selective installation of a rack 10 at any desired lateral location within the cabinet 12.

The rear crossbar 28R is elevated slightly relative to the front crossbar 28F so as to tilt the rack 10 into an inclined orientation wherein the rack 10 is inclined upwardly away from the dispensing station 24, in the direction from the front toward the back of the cabinet 12, thereby enabling the bottles 20 to be biased by gravity in the forward direction, along line 22, toward the dispensing station 24. A plurality of racks 10 may be affixed to the crossbars 28, in side-by-side arrangement, to provide a corresponding plurality of lines 22 of bottles 20 between the opposite side walls 30 of the cabinet 12. Front door 14 includes a panel 34 constructed of a transparent material, such as glass, so as to enable viewing of the bottles 20 through the door 14, in a now conventional manner, prior to selection and removal of a bottle 20 from rack 10.

Figure 2:
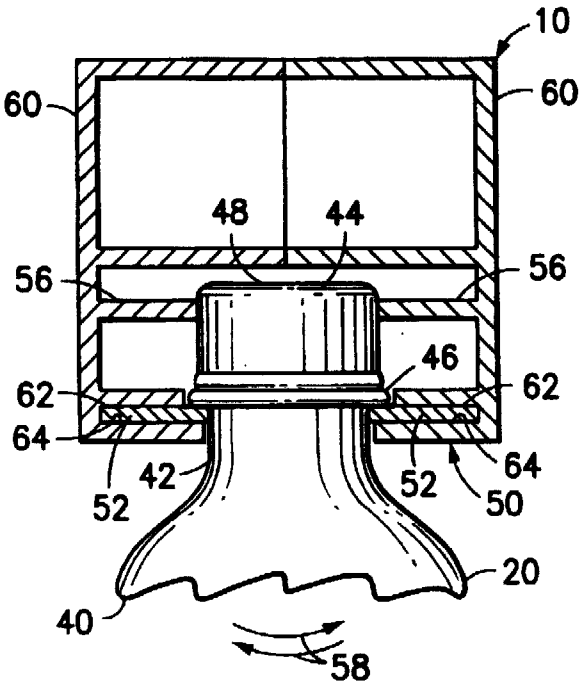
FIG. 2 is an enlarged cross-sectional view taken along line 2—2 of FIG. 1.
Figure 3:
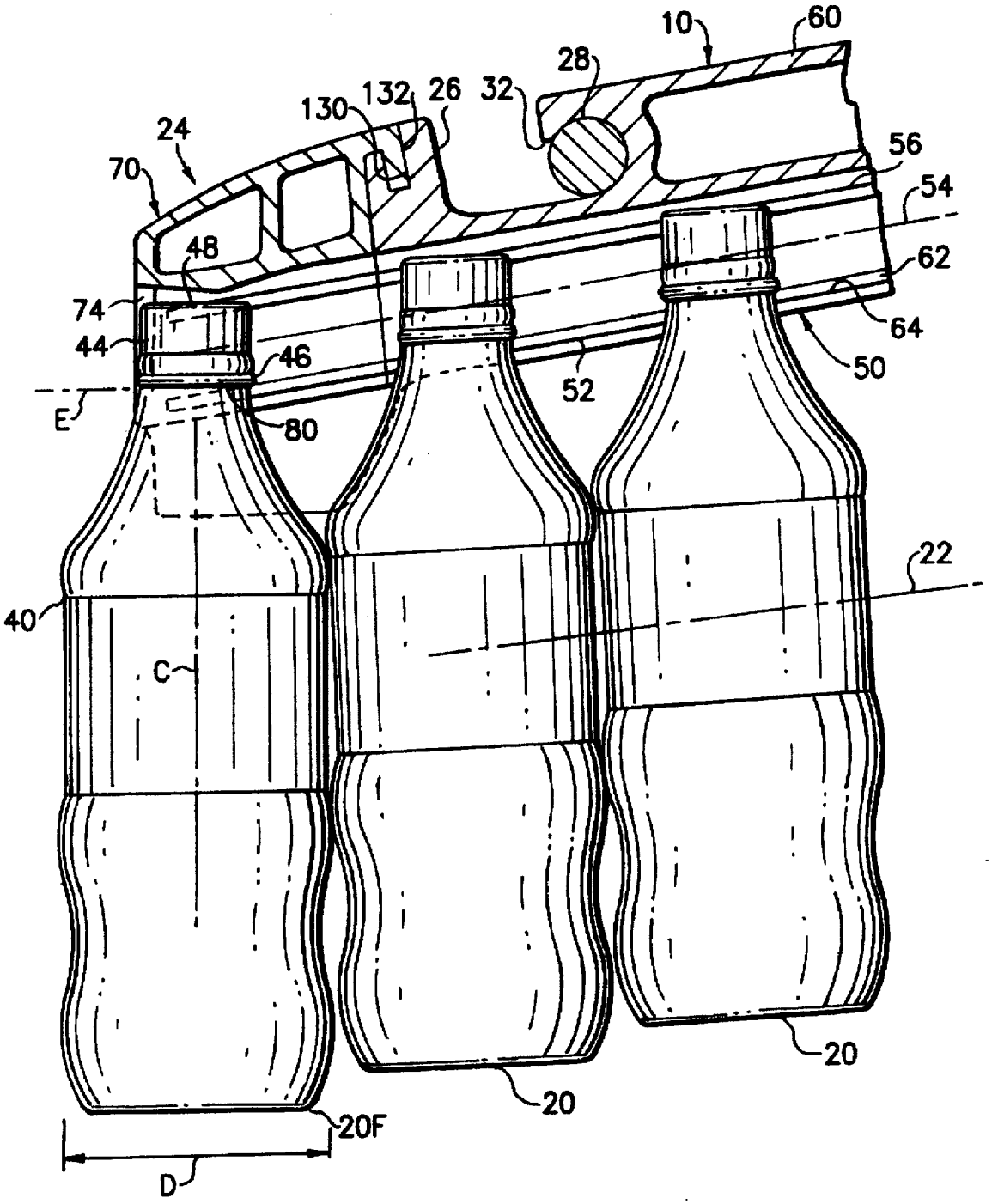
FIG. 3 is an enlarged fragmentary longitudinal cross-sectional view of a portion of the rack of FIG. 1.
Figure 6:
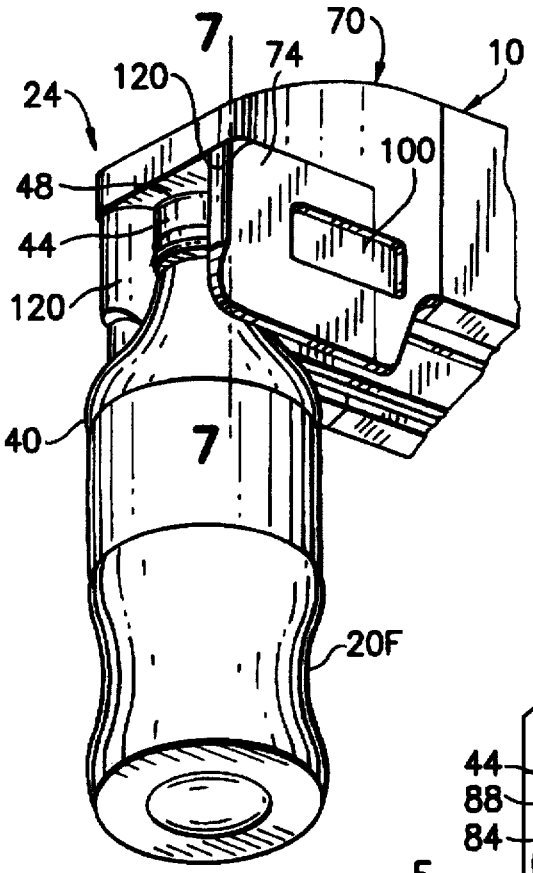
FIG. 6 is a fragmentary pictorial perspective view of the front of the rack.
Figure 7:
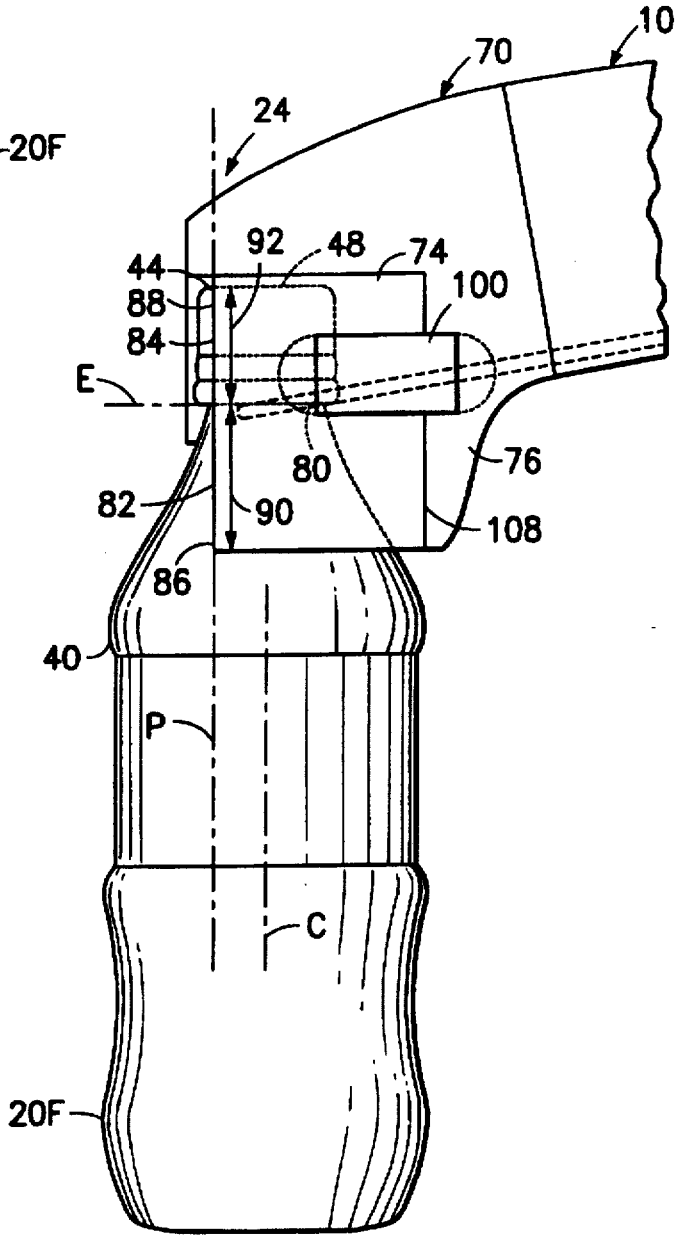
FIG. 7 is an enlarged side elevational view of the fragment of FIG. 6, with a component part partially broken away along line 7—7 of FIG. 6.

As best seen in FIGS. 2 and 3, as well as in FIG. 1, bottles 20 are of the type which are blow molded of a synthetic polymeric material, each bottle 20 having a generally cylindrical overall configuration with a vertical centerline C and an overall diameter D, and including a body portion 40 having a particular given surface contour configuration, a neck 42 extending upwardly from the body portion 40, and a cap portion 44 above the neck 42, the cap portion 44 also having a predetermined surface contour configuration, including the surface contour configuration of a cap 48 carried upon the cap portion 44. A collar 46 is molded unitary with the neck 42 and extends radially outwardly. Each rack 10 includes a track 50 extending along the incline of rack 10 and having an opposed pair of rails 52 for engaging laterally opposite portions of the collar 46 of each bottle 20 so as to suspend the bottles 20 along the incline with the bottles 20 biased by gravity forwardly along a path of travel 54 toward the dispensing station 24. The forwardmost bottle 20F is suspended from rails 52 at the dispensing station 24.

Track 50 further includes a pair of laterally opposite guides 56 extending along the track 50 above the rails 52 for juxtaposition with the cap portion 44 of each bottle 20 so as to engage each cap portion 44, at the cap 48, to stabilize the bottles 20 against swinging movements in directions transverse to line 22, as indicated by the arrows 58 in FIG. 2. In this manner, advancement of the bottles 20 along the path of travel 54, in response to the biasing force of gravity, is facilitated.

In the preferred construction, rack 10 includes an elongate track support member shown in the form of assembled mirror-image molded side pieces 60, and rails 52 are in the form of strips 62 of durable material, as, for example, steel or a relatively high strength synthetic polymeric material having good lubricity characteristics, such as Delrin or Celcon, seated in complementary slots 64 in the side pieces 60. In this manner, rack 10 is manufactured economically and is made rugged for exemplary performance over a long service life. Alternately, rails 52 can be molded unitary with side pieces 60.

Turning now to FIGS. 4 through 7, as well as to FIGS. 1 through 3, The forwardmost bottle 20F is suspended from rails 52 at a suspension location 80, at a predetermined elevation E at the dispensing station 24, the suspension location 80 being placed behind the vertical centerline C, by virtue of the incline of track 50. As a result of the placement of the suspension location 80 relative to the centerline C of bottle 20F, the bottle 20F has a tendency to pivot, in response to the force of gravity, about the suspension location 80, out of a vertical orientation, with the cap portion 44 urged forward and the body portion 40 urged backward. At the same time, the forward force of the bottles 20 behind bottle 20F tends to urge the body portion 40 of the bottle 20F forward. In order to retain the forwardmost bottle 20F at the dispensing station 24, with the bottle 20F maintained at a desired essentially vertical orientation for presentation to a prospective purchaser, rack 10 is provided with a gate module in the form of a nose member 70 at the dispensing station 24, the nose member 70 including a gate 72 providing stop means in the form of a pair of gate members 74 hinged to side walls 76 of the nose member 70 for swinging movements in lateral directions relative to the line 22 of bottles 20.

Each gate member 74 has a first engagement surface 82 extending along the gate member 74 downwardly from the elevation E of the suspension location 80 on the rails 52 in a first essentially vertical direction for engaging generally vertically oriented body portion 40 of the bottle 20F placed at the dispensing station 24, below the elevation E of the suspension location 80, and the rails 52. Further, each gate member 74 has a second engagement surface 84 extending along the gate member 74 upwardly from the elevation E of the suspension location 80 in a second essentially vertical direction for engaging the cap portion 44 of bottle 20F, above the elevation E of the suspension location 80, and the rails 52. Both the first engagement surface 82 and the second engagement surface 84 are placed longitudinally forward of the suspension location 80 and the centerline C. In this manner, the bottle 20F is held in a desired generally vertical position by being engaged at the suspension location 80 at the collar 46 by the rails 52 and at laterally spaced apart lower stabilizing locations 86 placed below the elevation E of suspension location 80 and longitudinally forward of suspension location 80 and centerline C, and at laterally spaced apart upper stabilizing locations 88 placed above the elevation E of the suspension location 80 and longitudinally forward of suspension location 80 and centerline C, by the engagement surfaces 82 and 84, the stabilizing locations 86 and 88 being spaced vertically downwardly and upwardly, respectively, away from the rails 52 and the elevation E of suspension location 80, and the respective opposed pairs of stabilizing locations 86 and 88 being spaced laterally in opposite lateral directions relative to line 22, thereby providing corresponding spaced apart engagement locations on the bottle 20F, spaced apart both vertically and laterally, forward of suspension location 80 and forward of centerline C, for a high degree of stability.

In order to enhance the stability of the bottle 20F at the desired orientation, the engagement surfaces 82 each are provided with a length 90 extending along the first vertical direction from adjacent elevation E to corresponding stabilizing location 86, and a profile contour configuration along length 90 essentially complementary to the surface contour configuration of the body portion 40 of the bottle 20F, and the engagement surfaces 82 each engage the body portion 40 essentially along the entire length 90. Likewise, the engagement surfaces 84 each are provided with a length 92 extending along the second vertical direction from adjacent elevation E to corresponding stabilizing location 88, and a profile contour configuration along length 92 essentially complementary to the surface contour configuration of the cap portion 44 of bottle 20F, and the engagement surfaces 84 each engage the cap portion 44 essentially along the entire length 92. In addition, the engagement surfaces 82 and 84 lie in a common lateral plane P extending along the vertical directions forward of the suspension location 80 and forward of the centerline C of bottle 20F. The total of the lengths 90 and 92 and the profile configurations of the engagement surfaces 82 and 84 assure that the bottle 20F is engaged positively along portions of the bottle 20F sufficient to stabilize the bottle 20F in the desired orientation.

It has been observed that the forces exerted by gravity, including the forces exerted by the subsequent bottles 20 on the forwardmost bottle 20F, tend to urge the bottle 20F out of the desired generally vertical orientation; however, the provision of vertically elongated engagement surfaces 82 and 84 engaging bottle 20F along laterally spaced apart lower stabilizing locations 86 and along laterally spaced apart upper stabilizing locations 88, respectively, forward of suspension location 80 and centerline C, resists those forces. Further, the forces exerted upon each bottle 20 by subsequent bottles 20 in the line 22 tend to swing bottles 20, as well as bottle 20F, toward the one side or the other, resulting in a skewing of the bottles 20 toward one or the other side of line 22. Such swinging movements, and concomitant skewing, are resisted by the guides 56 which engage the cap portion 44 of the bottles 20 to maintain the bottles 20 aligned behind one another, along line 22.

The gate members 74 are hinged upon the side walls 76 for lateral swinging movements between the closed position, shown in full lines in FIGS. 4 and 5, wherein the engagement surfaces 82 and 84 engage the bottle 20F to retain the bottle 20F in place at the dispensing station 24, and an open position, shown in phantom in FIG. 5. A leaf spring 100 urges each gate member 74 into the closed position with a biasing force sufficient to retain the bottle 20F in place. When it is desired to release bottle 20F from the nose member 70, the bottle 20F merely is grasped and pulled forward with a force sufficient to overcome the biasing forces of the leaf springs 100 on the gate members 74 and move the gate members 74 to the open position. Gate 72 is thus opened and the bottle 20F is released.

Once bottle 20F is released, the next bottle 20 in line 22 will be biased forward by the force of gravity to take its place as the forwardmost bottle, to be retained within the dispensing station 24 by gate members 74, which gate members 74 are returned to the closed position by the leaf springs 100. As best seen in FIG. 5, each leaf spring 100 is secured within a corresponding gate member 74, at 104, and is secured within a corresponding side wall 76, at 106, thereby straddling the border 108 between gate member 74 and side wall 76. Tabs 110 on gate members 74 engage complementary slots 112 in side walls 76 to establish a hinged connection between each gate member 74 and the corresponding side wall 76, while leaf springs 100 bias the gate members 74 into the closed position, where the gate members 74 rest against corresponding forward extensions 114 of side walls 76.

Should the prospective purchaser decide, for one reason or another, to return the selected bottle 20 to the rack 10 after first having released and removed bottle 20, as described above, the purchaser merely need align the bottle 20 with the nose member 70, in juxtaposition with gate 72, and then push the released bottle 20 in the rearward direction, back through the gate 72 and into the nose member 70. Such insertion of a bottle 20 back into the rack 10 is facilitated by lead-in surfaces 120 which are flared laterally outwardly in the forward direction to ease insertion and open the gate members 74 for admitting the neck 42 of the bottle 20 into the nose member 70. Loading of the rack 10 with bottles 20 can be accomplished from the front of the cabinet 12 in the same manner as described in connection with re-insertion of a released bottle 20. Alternately, where the cabinet 12 provides access to the rearward end 122 of the rack 10, the suspending arrangement enables the rack 10 to be loaded from the rearward end 122 of the rack 10 by merely inserting bottles 20 into track 50 from the rearward end 122 of the rack 10.

Figure 8:
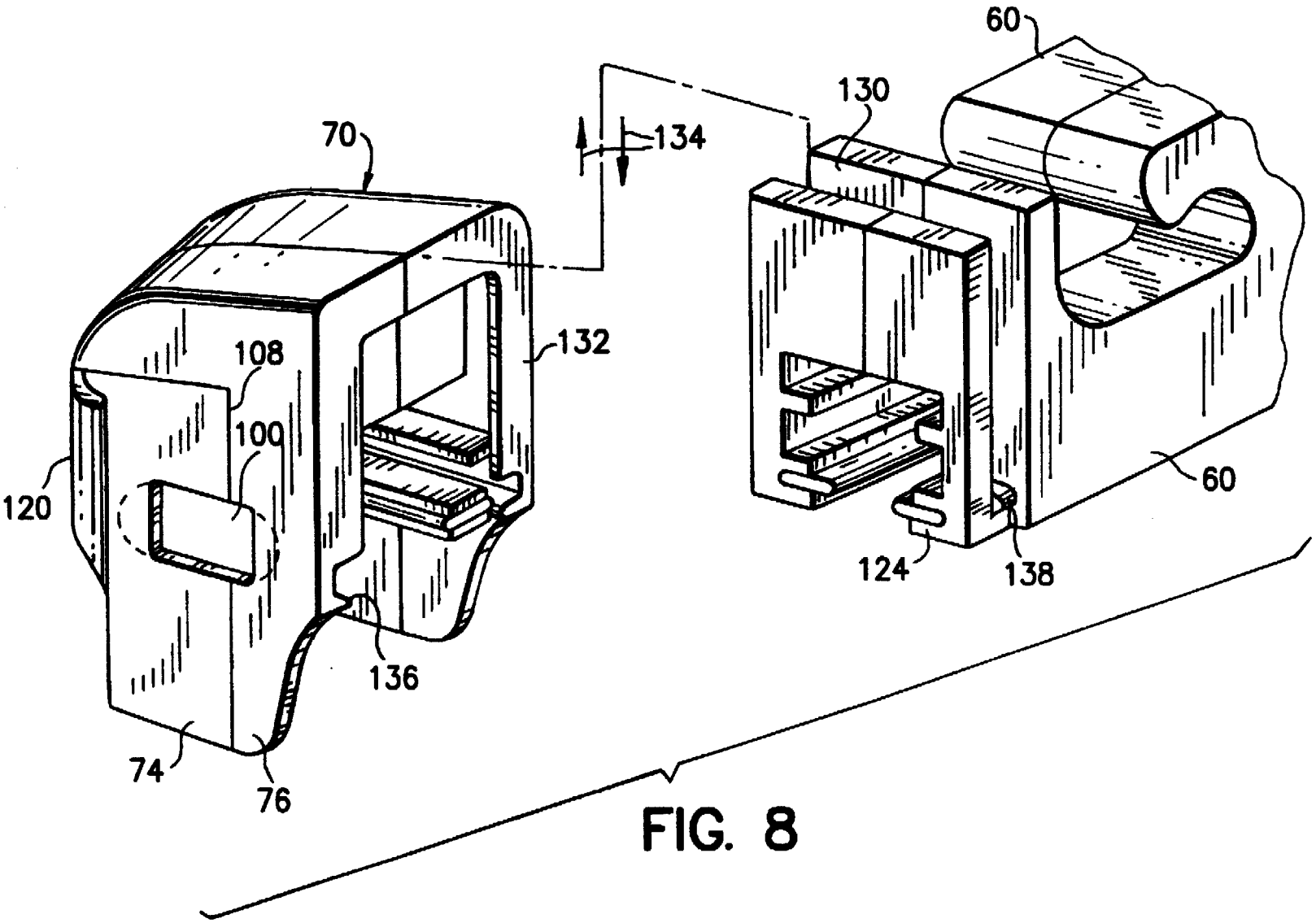
FIG. 8 is an exploded perspective view of a portion of the rack.

Since gate 72 includes contoured engagement surfaces 82 and 84 having a profile contour configuration matched to a particular bottle size and configuration, rack 10 is provided with an arrangement which enables the accommodation of bottles 20 of a variety of sizes and configurations. Thus, as shown in FIG. 8, the forward end 124 of the assembled side pieces 60 includes a connector element in the form of a grooved receptacle 130, and the nose member 70 includes a complementary connector element in the form of a splined connector 132 so that the nose member 70 selectively is connected or disconnected from the assembled side pieces 60 by moving the nose member 70 in the downward and upward directions, respectively, as indicated by the arrows 134 to engage or disengage the splined connector 132 and the receptacle 130. Complementary detent elements 136 and 138 retain the nose member 70 in place on the forward end 124 of the assembled side pieces 60. The nose member 70 thus comprises a module which is interchangeable with similar modules having different dimensions and contour configurations for matching the particular bottles to be displayed and dispensed in the rack 10. By merely selecting the appropriate module, and then attaching that module to the assembled side pieces 60, the rack 10 is modified to accept any one of a variety of bottle sizes and shapes without the necessity for removing the rack 10 from the cabinet 12, or dismantling the rack 10 beyond the mere replacement of the nose member 70. Since the nose member 70 is located at the forward end of the rack 10, ease of access is assured, rendering such a changeover easy to accomplish in the field.

Further, should it become necessary to remove the rack 10 itself from the cabinet 12, the rack 10 need merely be moved rearwardly relative to crossbars 28, along the L-shaped slots 26 to overcome the detents 32, and then lowered from the crossbars 28, rendering maintenance or replacement easily accomplished in the field. In the preferred construction, the width W of nose member 70 (see FIG. 5) is made at least as great as the overall diameter D of the bottles 20 so that selection and installation of a particular nose member 70 also attains an appropriate side-to-side spacing between adjacent racks 10 in the cabinet 12. Alternately, minor variations in the side-to-side spacing between adjacent racks 10 can be accomplished by mounting spacers (not shown) upon the crossbars 28 between adjacent racks 10.

It will be apparent that the present invention attains the several objects and advantages summarized above, namely:

Provides a rack for delivering bottles serially, by gravity, to a dispensing station where a bottle is retained positively in a stable, desired orientation for presentation to a prospective purchaser; enables the desired cleanliness, appearance and consistent operation while attaining increased stability among the bottles stored along the rack, as well as in the bottles presented at the dispensing station; is adapted readily, in the field, to accommodating bottles of various sizes and configuration, selectively, without excessive modification; provides a relatively simple construction, made available economically for use in connection with a wide variety of dispensing units; enables increased ease of installation, maintenance and use; provides a rugged construction capable of reliable operation over a relatively long service life.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A rack for storing and presenting, for serial dispensing, a plurality of bottles suspended from the rack in a line extending longitudinally essentially parallel to the rack, the rack having a forward end and a rearward end, the bottles including a generally vertical body portion having a given surface contour configuration, a neck extending upwardly from the body portion, and a cap portion above the neck, the cap portion having a predetermined surface contour configuration, the rack comprising:

a dispensing station located adjacent the forward end of the rack such that the line extends through the dispensing station;

a track extending along an incline upwardly and rearwardly away from the dispensing station toward the rearward end for supporting the plurality of bottles along the line, with the bottles biased by gravity forwardly along a path of travel toward the dispensing station, the track being adapted to engage the neck of each bottle at a suspension location placed at an elevation in the dispensing station; and a gate at the dispensing station, the gate including stop means placed in the path of travel for engaging the forwardmost bottle of the plurality of bottles to retain the plurality of bottles in the rack;

the stop means including at least one first engagement surface extending downwardly from the elevation of the suspension location along a first essentially vertical direction for engaging the generally vertical body portion of the forwardmost bottle at a corresponding at least one lower stabilizing location spaced away from the suspension location, vertically below the elevation of the suspension location, and at least one second engagement surface extending upwardly from the elevation of the suspension location along a second essentially vertical direction for engaging the cap portion of the forwardmost bottle at a corresponding at least one upper stabilizing location spaced away from the suspension location, vertically above the elevation of the suspension location, and resilient biasing means for resiliently biasing the first engagement surface into engagement with the generally vertical body portion of the forwardmost bottle at said corresponding lower stabilizing location and for resiliently biasing the second engagement surface into engagement with the cap portion of the forwardmost bottle at said corresponding upper stabilizing location such that the forwardmost bottle is maintained suspended at the dispensing station in an essentially vertical orientation against the force of gravity, including the forward force of the remaining bottles suspended along the line behind the forwardmost bottle, and is selectively released from the dispensing station by pulling the forwardmost bottle forward through the gate, against the resilient bias of the resilient biasing means.

2. The invention of claim 1 wherein the upper and lower stabilizing locations are placed longitudinally forward of the suspension location.

3. The invention of claim 1 wherein the first engagement surface has a first length extending along the first essentially vertical direction for engaging the body portion of the forwardmost bottle essentially from adjacent the elevation of the suspension location, along the first length, to the lower stabilizing location to stabilize the forwardmost bottle in the essentially vertical orientation.

4. The invention of claim 3 wherein the first engagement surface has a profile contour configuration along the first length generally complementary to the given surface contour configuration of the body portion of the forwardmost bottle along the first essentially vertical direction.

5. The invention of claim 1 wherein the second engagement surface has a second length extending along the second essentially vertical direction for engaging the cap portion of the forwardmost bottle essentially from adjacent the elevation of the suspension location, along the second length, to the upper stabilizing location to stabilize the forwardmost bottle in the essentially vertical orientation.

6. The invention of claim 5 wherein the second engagement surface has a profile contour configuration along the second length generally complementary to the predetermined surface contour configuration of the cap portion of the forwardmost bottle along the second essentially vertical direction.

7. The invention of claim 1 wherein the first engagement surface has a first length extending along the first essentially vertical direction for engaging the body portion of the forwardmost bottle essentially from adjacent the elevation of the suspension location, along the first length, to the lower stabilizing location, and the second engagement surface has a second length extending along the second essentially vertical direction for engaging the cap portion of the forwardmost bottle essentially from adjacent the elevation of the suspension location, along the second length, to the upper stabilizing location to stabilize the forwardmost bottle in the essentially vertical orientation.

8. The invention of claim 7 wherein the first engagement surface has a profile contour configuration along the first length generally complementary to the given surface contour configuration of the body portion of the forwardmost bottle along the first essentially vertical direction, and the second engagement surface has a profile contour configuration along the second length generally complementary to the predetermined surface contour configuration of the cap portion of the forwardmost bottle along the second essentially vertical direction.

9. The invention of claim 8 wherein the upper and lower stabilizing locations are placed longitudinally forward of the suspension location.

10. The invention of claim 9 wherein the profile contour configuration of the first engagement surface and the profile contour configuration of the second engagement surface lie in a common plane extending in the essentially vertical directions.

11. The invention of claim 1 wherein the stop means include a pair of opposed first engagement surfaces spaced away from the suspension location, vertically below the elevation of the suspension location, and spaced apart laterally for engaging the body portion of the forwardmost bottle at corresponding opposed lower stabilizing locations spaced vertically below the elevation of the suspension location and spaced laterally in opposite lateral directions relative to the line.

12. The invention of claim 11 wherein each first engagement surface has a first length extending along the first essentially vertical direction and a profile contour configuration along the first length generally complementary to the given surface contour configuration of the body portion of the forwardmost bottle along the first essentially vertical direction.

13. The invention of claim 1 wherein the stop means include a pair of opposed second engagement surfaces spaced away from the suspension location, vertically above the elevation of the suspension location, and spaced apart laterally for engaging the cap portion of the forwardmost bottle at corresponding opposed upper stabilizing locations spaced vertically above the elevation of the suspension location and spaced laterally in opposite lateral directions relative to the line.

14. The invention of claim 13 wherein each second engagement surface has a second length extending along the second essentially vertical direction and a profile contour configuration along the second length generally complementary to the predetermined surface contour configuration of the cap portion of the forwardmost bottle along the second essentially vertical direction.

15. The invention of claim 1 wherein the stop means include a pair of opposed first engagement surfaces spaced away from the suspension location, vertically below the elevation of the suspension location, and spaced apart laterally for engaging the body portion of the forwardmost bottle at corresponding opposed lower stabilizing locations spaced vertically below the elevation of the suspension location and spaced laterally in opposite lateral directions relative to the line, and a pair of opposed second engagement surfaces spaced away from the suspension location, vertically above the elevation of the suspension location, and spaced apart laterally for engaging the cap portion of the forwardmost bottle at corresponding opposed upper stabilizing locations spaced vertically above the suspension location and spaced laterally in opposite lateral directions relative to the line.

16. The invention of claim 15 wherein each first engagement surface has a first length along the first essentially vertical direction and a profile contour configuration along the first length generally complementary to the given surface contour configuration of the body portion of the forwardmost bottle along the first essentially vertical direction, and each second engagement surface has a second length extending along the second essentially vertical direction and a profile contour configuration along the second length generally complementary to the predetermined surface contour configuration of the cap portion of the forwardmost bottle along the second essentially vertical direction.

17. The invention of claim 16 wherein the upper and lower stabilizing locations are placed longitudinally forward of the suspension location.

18. The invention of claim 17 wherein the profile contour configurations of the first engagement surfaces and the profile contour configurations of the second engagement surfaces all lie in a common lateral plane extending in the essentially vertical directions.

19. The invention of claim 1 wherein the track includes an opposed pair of rails for engaging corresponding opposed portions of the neck of each bottle, the invention including an opposed pair of guides extending along the track above the rails to be juxtaposed with the cap portion of each bottle for engagement with each cap portion to stabilize the bottles against swinging movements in directions transverse to the line and thereby maintain the plurality of bottles aligned along the line for facilitating advancement of the bottles along the path of travel in response to gravity.

20. The invention of claim 1 wherein the stop means include a gate member located laterally at each side of the path of travel at the dispensing station, and the resilient biasing means biases the gate members into the path of travel.

21. The invention of claim 20 wherein each gate member includes a lead-in surface flared laterally outwardly in the forward direction for facilitating the reception of a neck of a bottle and resilient displacement of the gate member to open the gate and admit a bottle pushed rearwardly along the path of travel for suspending the bottle on the rack.

22. The invention of claim 20 wherein the gate members include a pair of opposed first engagement surfaces spaced away from the suspension location, vertically below the elevation of the suspension location, and spaced apart laterally for engaging the body portion of the forwardmost bottle at corresponding opposed lower stabilizing locations spaced vertically below the elevation of the suspension location and laterally in opposite lateral directions relative to the line, and a pair of opposed second engagement surfaces spaced away from the suspension location, vertically above the elevation of the suspension location, and spaced apart laterally for engaging the cap portion of the forwardmost bottle at corresponding opposed upper stabilizing locations spaced vertically above the elevation of the suspension location and laterally in opposite lateral directions relative to the line.

23. The invention of claim 22 wherein each first engagement surface has a first length extending along the first essentially vertical direction and a profile contour configuration along the first length generally complementary to the given surface contour configuration of the body portion of the forwardmost bottle along the first essentially vertical direction for engaging the body portion of the forwardmost bottle essentially from adjacent the elevation of the suspension location, along the first length, to the lower stabilizing locations, and each second engagement surface has a second length extending along the second essentially vertical direction and a profile contour configuration along the second length generally complementary to the cap portion of the forwardmost bottle for engaging the cap portion of the forwardmost bottle essentially from adjacent the elevation of the suspension location, along the second length, to the upper stabilizing locations to stabilize the forwardmost bottle in the essentially vertical orientation.

24. The invention of claim 23 wherein the upper and lower stabilizing locations are placed longitudinally forward of the suspension location.

25. The invention of claim 24 wherein the profile contour configurations of the first engagement surfaces and the profile contour configurations of the second engagement surfaces all lie in a common lateral plane extending in the essentially vertical directions.

26. The invention of claim 24 wherein the track includes an opposed pair of rails for engaging corresponding opposed portions of the neck of each bottle, the invention including an opposed pair of guides extending along the track above the rails to be juxtaposed with the cap portion of each bottle for engagement with each cap portion to stabilize the bottles against swinging movements in directions transverse to the line and thereby maintain the plurality of bottles aligned along the line for facilitating advancement of the bottles along the path of travel in response to gravity.

27. The invention of claim 26 wherein the track includes an elongate track support member and the gate comprises a gate module mounted upon the track support member for selective removal and replacement to adapt the rack to accommodate a plurality of bottles, each bottle having a particular configuration and dimensions, including an overall diameter.

28. The invention of claim 1 wherein the track includes an elongate track support member and the gate comprises a gate module mounted upon the track support member for selective removal and replacement to adapt the rack to accommodate a plurality of bottles, each bottle having a particular configuration and dimensions, including an overall diameter.

29. The invention of claim 28 wherein the track support member and the gate module include complementary connector elements for selective connection and disconnection of the gate module and the track support member.

* * * * *